US005143388A

United States Patent [19]

Chen

[11] Patent Number: 5,143,388

[45] Date of Patent: Sep. 1, 1992

[54] INTEGRAL MOLDED SKATE TRUCK

[75] Inventor: Ting-Hsing Chen, Tainan Hsien, Taiwan

[73] Assignee: Far Great Plastics Industrial Co., Ltd., Tainan Hsien, Taiwan

[21] Appl. No.: 690,480

[22] Filed: Apr. 24, 1991

[51] Int. Cl.[5] ..... A63C 17/02

[52] U.S. Cl. ..... 280/11.28; 280/87.042

[58] Field of Search ..... 280/7.13, 11.17, 11.19, 280/11.2, 11.27, 11.28, 87.03, 87.041, 87.042

[56] References Cited

U.S. PATENT DOCUMENTS

| | | | |
|---|---|---|---|
| 302,503 | 7/1884 | Lincoln | 280/11.28 |
| 3,024,033 | 3/1962 | Skaggs | 280/11.28 |
| 4,168,842 | 9/1979 | Kimmell et al. | 280/11.28 |
| 4,180,278 | 12/1979 | Gottlieb | 280/11.28 X |
| 4,184,693 | 1/1980 | Whitmarsh | 280/87.042 X |
| 4,398,735 | 8/1983 | Evans et al. | 280/11.28 |
| 4,402,521 | 9/1983 | Mongeon | 280/11.28 X |
| 4,844,492 | 7/1989 | Ludwig | 280/11.28 X |
| 4,930,794 | 6/1990 | Chan | 280/11.28 |

*Primary Examiner*—Andres Kashnikow
*Assistant Examiner*—Brian L. Johnson
*Attorney, Agent, or Firm*—Lowe, Price, LeBlanc & Becker

[57] ABSTRACT

A skate truck including a wheel assembly baseplate rigidly secured to the underside of a skateboard and with a curved recess depending therefrom, two beams integrally molded in a letter "V" are provided. One end of the beams is securely anchored to the baseplate and the other two ends are mounted in an obtuse angle to an axle hub. A peg extends upwardly from one side of the axle hub and is connected to a buffer which contacts or is adjacent to the curved recess to absorb wobble or vibration and also to maintain meneuverability and stability.

1 Claim, 4 Drawing Sheets

INTEGRAL MOLDED SKATE TRUCK

FIELD OF THE INVENTION

Roller skates are generally composed of two identical trucks with one truck located at the front and the other at the rear. Each truck has a baseplate adapted to attach to the underside of the skate, a beam having one end rigidly connected to the plate and extending downwardly at an angle with its end integral with a cylindrical axle hub connected thereto. The axle hub has a bore along the axis therethrough for insertion of an axle which is threaded at each end to connect with two wheels. When the rider is standing on the skate, the beam will normally absorb most of the rider's weight and the vibration caused by road and surface irregularities.

DESCRIPTION OF THE PRIOR ART

Skate trucks have been known heretofore, as shown in U.S. Pat. No. 4,398,735 to Evans et al. This truck includes a baseplate, a beam, and an axle hub injection molded in a one piece unit, and a peg with one of its ends connected to the baseplate and the other end adjacent to the top of the axle hub. This structure firstly prevents the beam from deflecting, secondly provides a pivot point for rotation, and lastly allows one to tailor characteristics of the truck to the individual rider. However, it exhibits some questions of whether a tiny point can hold and sustain the weight of an adult. When pressure is applied to the skateboard, the beam pushes the front axle hub backward and the rear axle hub forward. This pressure forces the central point of the axle hub to deviate from the central point of the mounting peg, especially when riding on road irregularities.

The inventor has, therefore, invented this molded skate truck which can solve such problems by integral injection molding of all the major parts in a one piece unit to increase the stability, the vibration resistance of the truck and still maintain its maneuverability.

SUMMARY OF THE INVENTION

It is the primary object of the present invention to provide an integral molded skate truck which can support a heavier weight.

It is another object of the present invention to provide an integral molded skate truck which has better stability, maneuverability, and vibration resistance.

It is still another object of the present invention to provide an integral molded skate truck which has parts that are more solid and more durable.

It is a further object of the present invention to provide an integral molded skate truck which is easy to assemble and disassemble.

DETAILED DESCRIPTION OF THE PREFERRED EMBODIMENT

Figure 1:
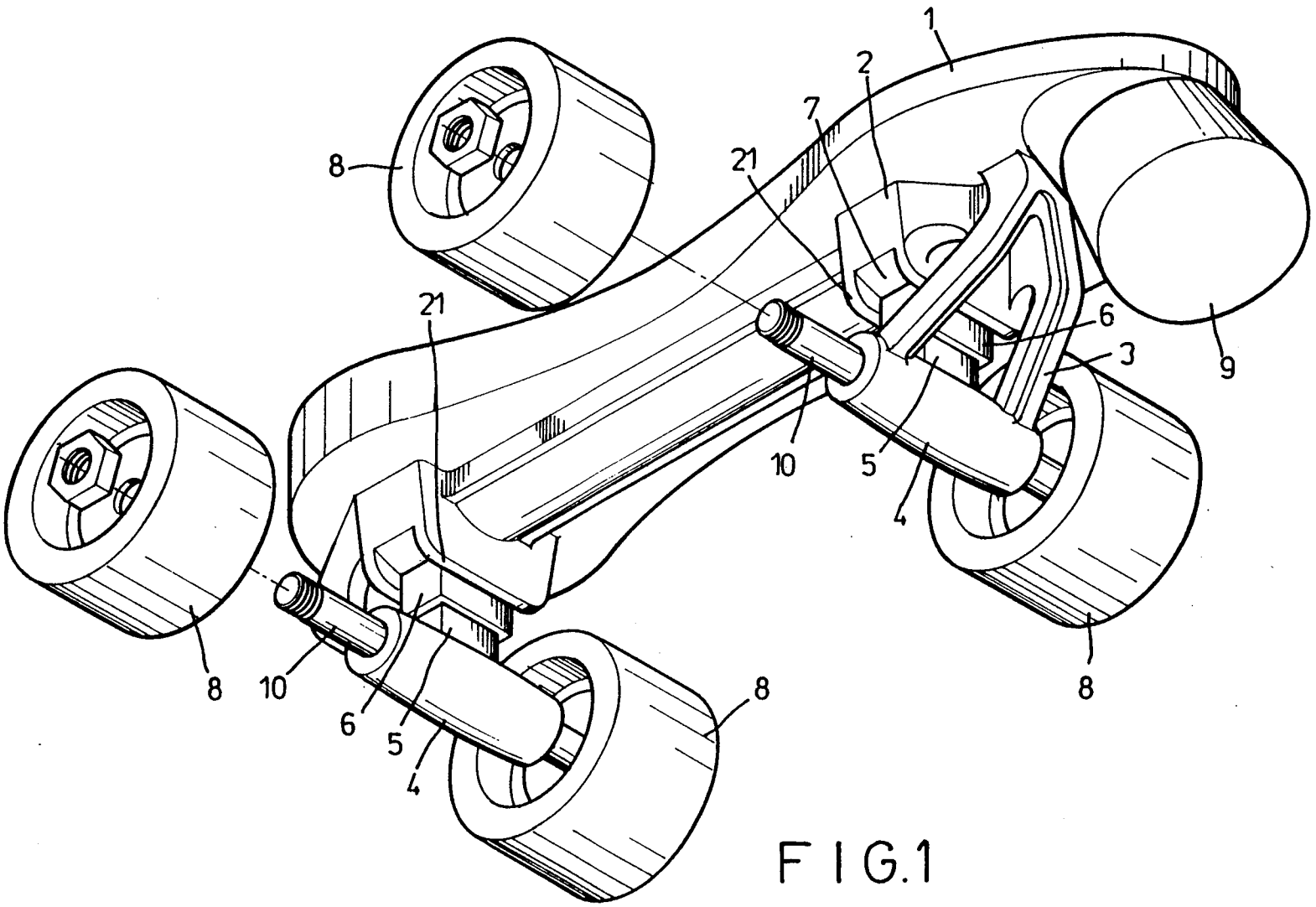
FIG. 1 is a perspective view of the present invention.
Figure 2:
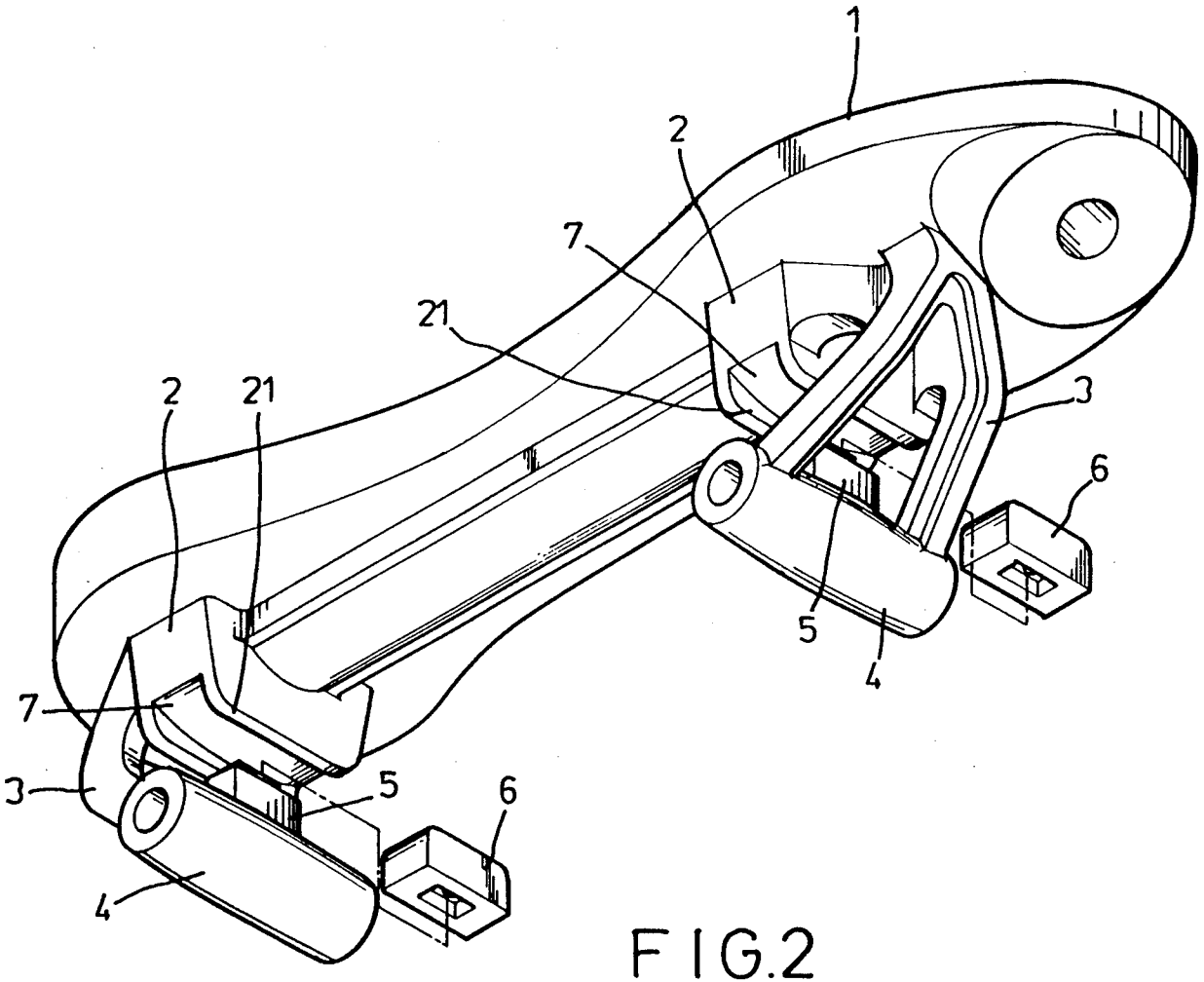
FIG. 2 is a fragmentary view of the present invention.
Figure 3A:
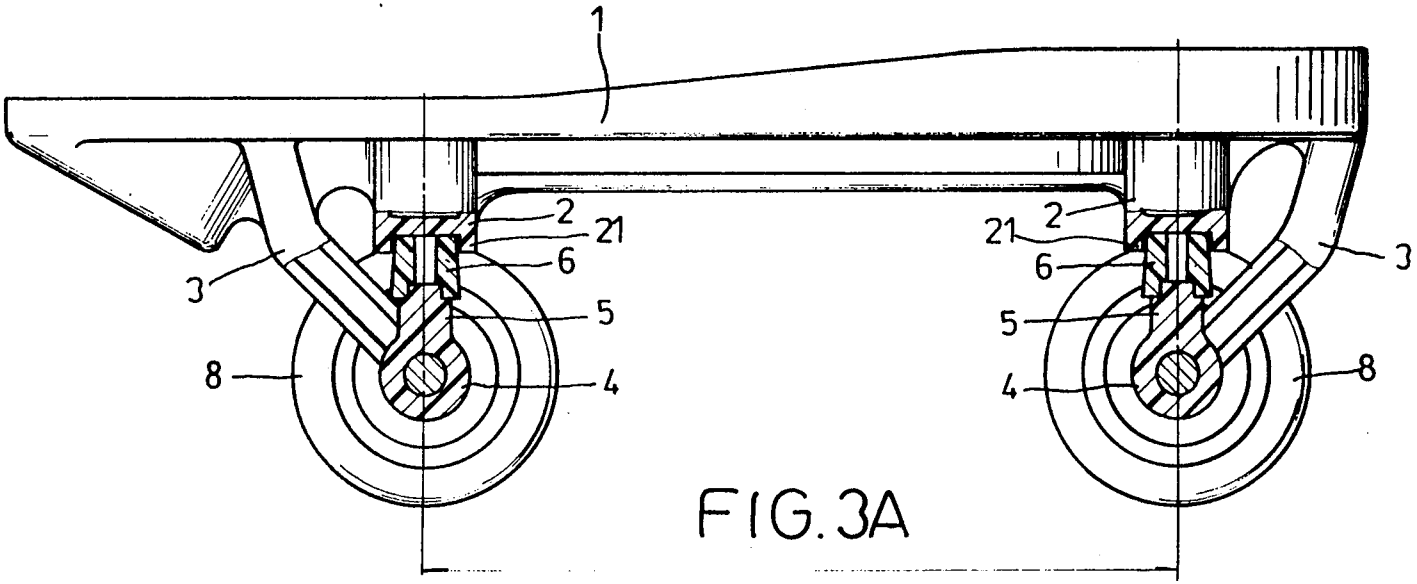
FIG. 3A is a side view of FIG. 1.

The present invention, shown as FIGS. 1 and 2, comprises a skateboard 1, having a wheel assembly baseplate 2, two beams 3, a cylindrical axle hub 4, a peg 5, and a curved recess 7 being all integral injection molded, and a buffer 6 being stacked on top of the peg 5. Wheels 8 and a stop member 9 are also provided. The baseplate 2 is rigidly anchored to the underside of the skateboard 1 and extending downwardly to form a curved recess 7 with its middle portion protruded outwardly and having two flanges 21 extended downwardly with one at its front end and one at its back end. Two beams 3 are provided having one end of each beam 3 connected and the other end angled outwardly to form the beams in a letter "V" with the common end secured to the underside of the skateboard 1 and extending its other two ends downwardly in an appropriate angle thereto. Cylindrical axle hub 4 is connected to the depending two ends of the beams 3 and extends perpendicular thereto aligned with the curved recess 7. The axle hub 4 has a bore therethrough for the insertion of an axle 10 and a peg 5 is mounted on its top side at an appropriate position. A buffer 6 made from a flexible material is rigidly connected to the top side of the peg 5 and is aligned with the curved recess 7. The buffer 6 and the peg 5 may be connected by a heat-melt method or any other known method. The curved recess 7 has two flanges 21 being arranged with one at its front side and one at back side such that the buffer 6 is positioned within the two flanges 21 and adjacent to the curved recess 7, shown as in FIG. 3A. The two flanges 21 of the recess 7 shall confine the movement of the buffer 6 within the two flanges 21. However, the distance from the front to the rear of the buffer is slightly less than the distance between the two flanges 21 of the recess 7 such that a clearance exists between the buffer 6 and the two flanges 21 to allow the buffer 6 to expand its size, when forces and stresses are applied to it.

Figure 3B:
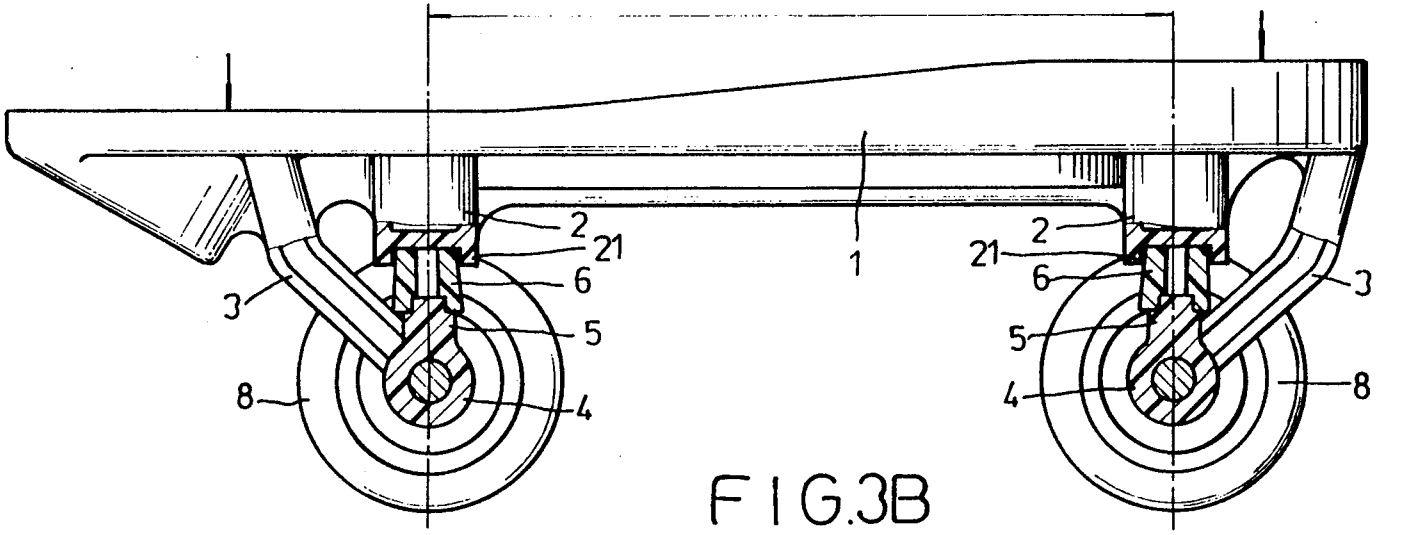
FIG. 3B is a side view of FIG. 3A in operation.

In operation, when rider stands on the skateboard 1, the beam 3 absorbs part of the forces from the rider's weight and vibrations from bumping road and constant twisting and turning, by bending inwardly and spreading outwardly. By bending it is meant to push the front cylindrical axle hub 4 rearward and the rear axle hub 4 frontward, while spreading means to force the left beam of beams 3 leftward and the right one rightward. The buffer 6 contacts the curved surface of the recess 7 to assist the beam 3 to absorb some of the forces, stress, and vibrations, as shown in FIG. 3B. According to a basic theory of physics, if two objects are stacked, the more contact points the two objects have, the more stable they will be. It is therefore understood that the contact points of the buffer 6 and the recess 7 can increase the stability of the skateboard 1.

Figure 4B:
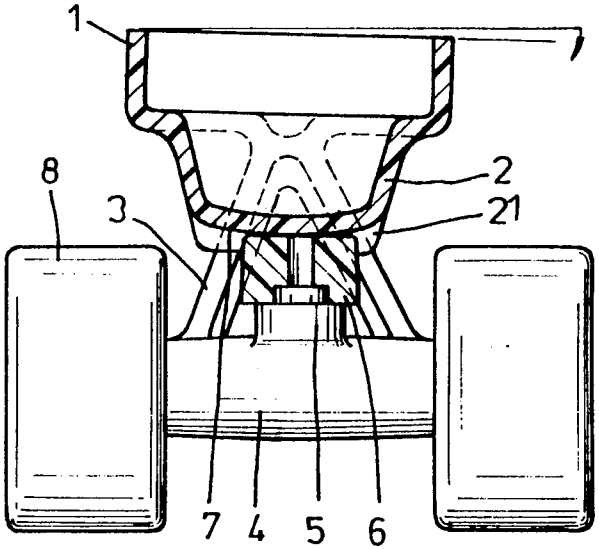
FIG. 4B is another cross sectional view of FIG. 4A showing in turning action.
Figure 4A:
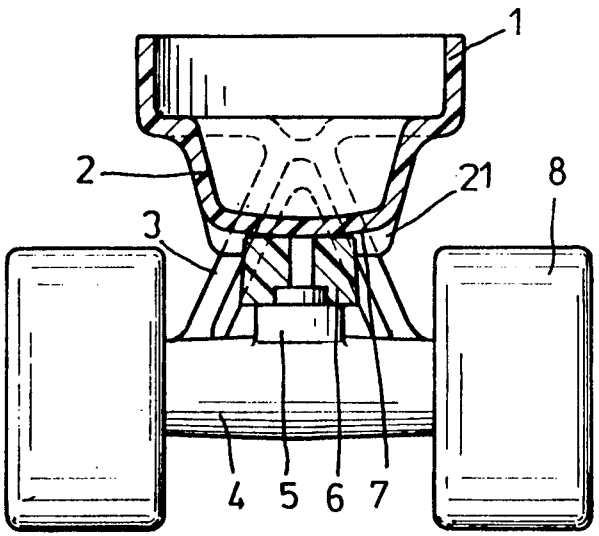
FIG. 4A is a cross sectional view of FIG. 1 taken from back of the truck toward the front position.

When the rider makes a turn, as shown in FIGS. 4A and 4B, the buffer 6 and the beam 3 receive different forces therefrom. For instance, in a left turn, the left side of the recess 7 and the left beam of beams 3 shall receive heavier forces and stresses than the right beam. Likewise, in a right turn, the heavier forces and the stresses will also be transferred onto the right hand beam of beams 3 and the right hand side of the recess 7. It is also to be noted that the widened contact points between the buffer 6 and the recess 7 do not decrease maneuverability because the buffer 6 can move freely left or right in recess 7 without increasing resistance on the axle hub 4, the axle 10, or the wheels 8 themselves.

I claim:

1. An integral injection molded skate truck for a skate comprising:

a baseplate wheel assembly being mounted on the underside of said skate and defining a laterally extending curved recess depending therefrom and formed by two downwardly extending flanges one at a front end and one at a rear end thereof; two beams having one end of each said beam connected together and formed with and depending from said baseplate and extended at an angle downwardly and outwardly therefrom; a cylindrical axle hub connected between the other ends of said beams extending perpendicularly thereto and being aligned with said curved recess; said cylindrical axle hub having a peg connected centrally thereto and extending upwardly, aligned with said curved recess, an upper portion thereof being stacked rigidly in a buffer; an upper portion of said buffer being received in said curved recess of said baseplate and being confined between said two flanges of said curved curved recess whereby said hub, peg, buffer and recess are vertically aligned.

* * * * *